US007561134B2

(12) United States Patent
Choi et al.

(10) Patent No.: US 7,561,134 B2
(45) Date of Patent: Jul. 14, 2009

(54) TFT-LCD DRIVING SYSTEM AND METHOD THEREOF

(75) Inventors: Woo-Young Choi, Seoul (KR); Joy Yim, Seoul (KR); Hyun-Woong Koh, Seoul (KR)

(73) Assignee: LG Electronics Inc., Seoul (KR)

( * ) Notice: Subject to any disclaimer, the term of this patent is extended or adjusted under 35 U.S.C. 154(b) by 589 days.

(21) Appl. No.: 11/054,859

(22) Filed: Feb. 9, 2005

(65) Prior Publication Data

US 2005/0174312 A1 Aug. 11, 2005

(30) Foreign Application Priority Data

Feb. 11, 2004 (KR) ..... 10-2004-0009108

(51) Int. Cl.
*G09G 3/36* (2006.01)

(52) U.S. Cl. ..... 345/92; 345/3.1; 345/87

(58) Field of Classification Search ..... 345/204, 345/2.1, 3.1, 87–100
See application file for complete search history.

(56) References Cited

U.S. PATENT DOCUMENTS 5,257,350 A 10/1993 Howard et al.
5,589,738 A * 12/1996 Onodaka et al. ..... 315/169.1
5,726,676 A * 3/1998 Callahan et al. ..... 345/98
6,219,451 B1 4/2001 Hunt et al.
6,236,393 B1 * 5/2001 Ogawa et al. ..... 345/211
6,295,046 B1 * 9/2001 Hebiguchi ..... 345/100
6,804,724 B2 * 10/2004 Shin ..... 710/2
2002/0003507 A1 * 1/2002 Dodge ..... 345/3.1
2002/0149541 A1 * 10/2002 Shin ..... 345/3.1
2006/0164404 A1 * 7/2006 Maone et al. ..... 345/204

FOREIGN PATENT DOCUMENTS

DE 203 12 372 10/2003
EP 0 708 399 9/1995

* cited by examiner

*Primary Examiner*—Richard Hjerpe
*Assistant Examiner*—Kimnhung Nguyen
(74) *Attorney, Agent, or Firm*—Lee, Hong, Degerman, Kang & Waimey

(57) ABSTRACT

Disclosed is a TFT-LCD driving system capable of allowing at least two kinds of TFT-LCD modules using respectively different interface techniques to be compatible in a mobile (portable) terminal using a TFT-LCD as a display device. The TFT-LCD driving system comprises: an LCD module detecting circuit for detecting a TFT-LCD module and generating an identification signal corresponding to an interface technique of the detected TFT-LCD module; a video controller for recognizing the interface technique of the detected TFT-LCD module on the basis of the generated identification signal and driving the detected TFT-LCD module according to the recognized interface technique; and an LCD module driving voltage supply unit for supplying a voltage for driving the detected TFT-LCD module.

22 Claims, 2 Drawing Sheets

TFT-LCD DRIVING SYSTEM AND METHOD THEREOF

Pursuant to 35 U.S.C. § 119(a), this non-provisional patent application claims the benefit of the earlier filing date and right of priority of Patent Application No. 10-2004-0009108, filed in Republic of Korea on Feb. 11, 2004, the entire contents of which are hereby incorporated by reference.

BACKGROUND OF THE INVENTION

1. Field of the Invention

The present invention relates to a system and method for driving a thin film transistor liquid crystal display (TFT-LCD), and particularly, to a TFT-LCD driving system and its method for a terminal using the TFT-LCD as its display device.

2. Description of the Prior Art

Recently, a variety of personal portable terminals, such as a mobile phone, a smart phone, a PDA phone providing functions as both the mobile phone and a personal digital assistant (PDA), and the like, have been developed and widely used. The various kinds of terminals have display devices and provide a user with information through the display devices. Recently-developed terminals provide enhanced multimedia functions to thereby reproduce high-resolution moving images. Also, since a terminal provided with a digital camera is coming into wide use, display devices that can offer good image quality are being required.

The terminal commonly uses a thin film transistor liquid crystal display (TFT-LCD) module as a display device, and the TFT-LCD module displays data through its own interface technique with a CPU or a video controller. As for the interface technique of the TFT-LCD module, there are an RGB interface, a data enable interface and the like. In the prior art, an interface between a main CPU or a video controller and the TFT-LCD, a display device, in one terminal is implemented as only one technique.

Hereinafter, an interface between a CPU or a video controller and a TFT-LCD module in a terminal in accordance with the prior art will be described with reference to FIGS. 1 and 2.

FIG. 1 is a block diagram showing a TFT-LCD driving system of an RGB interface technique in accordance with the prior art.

FIG. 2 is a block diagram showing a TFT-LCD driving system of a data enable interface technique in accordance with the prior art.

As shown in FIGS. 1 and 2, the TFT-LCD modules having respectively different interface techniques are not compatible with each other in one TFT-LCD driving system in accordance with the prior art. Therefore, TFT-LCD modules having different interface techniques are driven by different driving systems.

Namely, the TFT-LCD system can use only a TFT-LCD module having the same interface technique as its interface technique. For this reason, when it is intended that TFT-LCD modules having respectively different interface techniques are used in one terminal, different systems should be implemented as shown in FIGS. 1 and 2. Accordingly, there is an increasing need of a circuit structure and an interface method allowing TFT-LCD modules having different interface technologies to be used in one terminal.

A TFT-LCD module of an RGB interface technique requires three signal pins (i.e., a horizontal synchronization pin, a vertical synchronization pin, a data enable pin) in order to synchronize an LCD display screen while the TFT-LCD module of a data enable interface technique requires only one signal pin (i.e., data enable pin) in order to synchronize an LCD display screen. Because the data enable signal inputted to the data enable pin contains information on a horizontal synchronization signal and a vertical synchronization signal, the data enable interface technique desirably requires a small number of control signals compared with the RGB interface technique and can reduce the number of pins from three to one.

However, the TFT-LCD system using only one interface technique has compatibility problems since the system cannot use both TFT-LCD modules having respective different techniques.

SUMMARY OF THE INVENTION

Therefore, an object of the present invention is to provide a TFT-LCD driving system and its method which allows more than two kinds of TFT-LCD modules having respectively different interfaces to be compatible with each other in one mobile (terminal) terminal using a TFT-LCD as its display device.

To achieve these and other advantages and in accordance with the purpose of the present invention, as embodied and broadly described herein, there is provided a TFT-LCD driving system comprising: an LCD module detecting circuit for detecting a TFT-LCD module and generating an identification signal corresponding to an interface technique of the detected TFT-LCD module; a video controller for recognizing the interface technique of the detected TFT-LCD module on the basis of the generated identification signal and driving the detected TFT-LCD module according to the recognized interface technique; and an LCD module driving voltage supply unit for supplying a voltage for driving the detected TFT-LCD module.

To achieve these and other advantages and in accordance with the purpose of the present invention, as embodied and broadly described herein, there is provided a TFT-LCD driving method comprising: detecting a TFT-LCD module and generating an identification signal corresponding to an interface technique of the detected TFT-LCD module; and recognizing the interface technique of the detected TFT-LCD module on the basis of the generated identification signal and driving the detected TFT-LCD module according to the recognized interface technique.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, the preferred embodiment of the TFT-LCD driving system and its method capable of using TFT-LCD modules having respectively different interface techniques by detecting a TFT-LCD module, identifying an interface technique of the TFT-LCD module and generating an interface signal and a control signal for controlling the detected TFT-LCD module, will now be described.

Figure 1:
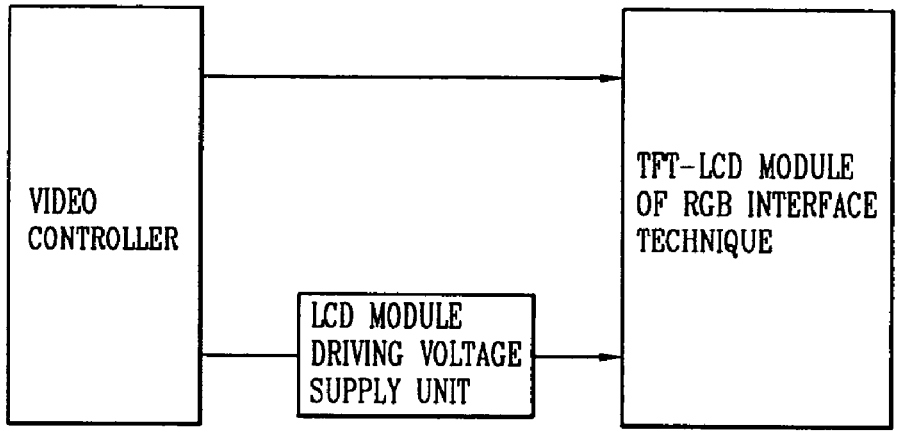
FIG. 1 PRIOR ART
FIG. 1 is a block diagram showing a TFT-LCD driving system of an RGB interface technique in accordance with the prior art.
Figure 2:
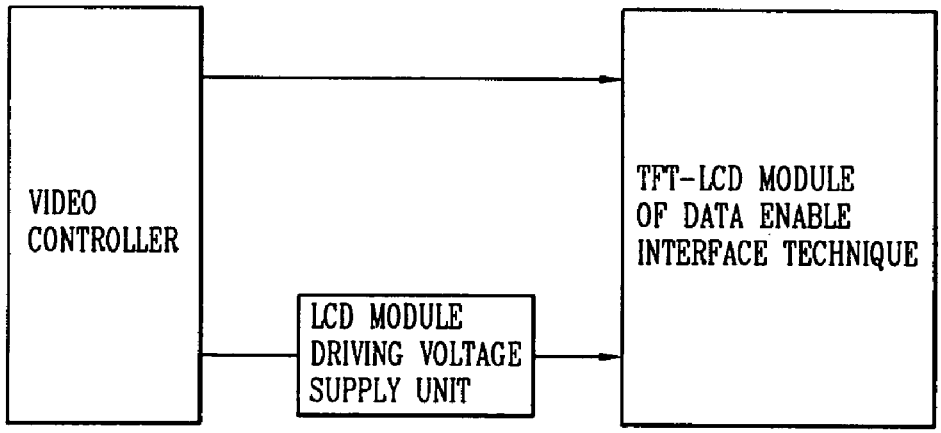
FIG. 2 PRIOR ART
FIG. 2 is a block diagram showing a TFT-LCD driving system of a data enable interface technique in accordance with the prior art.
Figure 3:
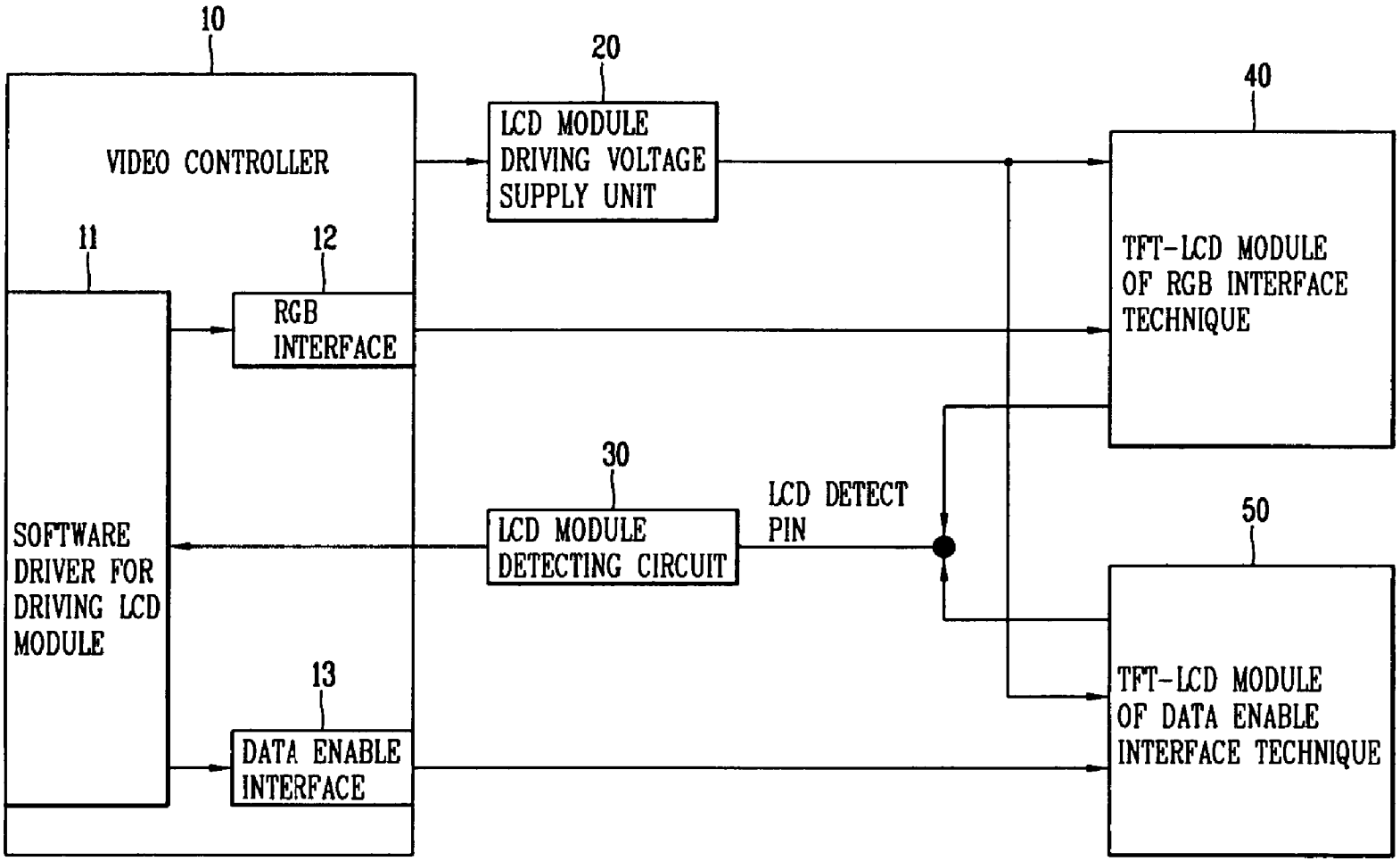
FIG. 3 is a block diagram showing an embodiment of the TFT-LCD driving system in accordance with the present invention.

FIG. 3 is a block diagram showing an embodiment of TFT-LCD driving system in accordance with the present invention. A case of using a TFT-LCD module of an RGB interface technique and a TFT-LCD module of a data enable interface technique is shown in FIG. 3.

As shown, the TFT-LCD driving system in accordance with the present invention comprises: an LCD module detecting circuit 30 for detecting a currently-mounted TFT-LCD module and generating an identification signal according to an interface technique of the detected TFT-LCD module; a video controller 10 including an LCD driving software driver 11 for driving the TFT-LCD module according to an interface technique of the detected TFT-LCD module, an RGB interface 12, and a data enable interface 13; and an LCD module driving voltage supply unit 20 for supplying a driving voltage for driving the detected TFT-LCD module. Here, a TFT-LCD module 40 of the RGB interface technique or a TFT-LCD module 50 of the data enable interface technique may be mounted in the TFT-LCD driving system.

First, the LCD module detecting circuit 30 detects a kind of TFT-LCD module that is being currently mounted in a system, generates an identification signal corresponding to an interface technique of the detected TFT-LCD module, and outputs the identification signal to the video controller 10.

Here, the TFT-LCD module can be detected by two kinds of methods.

In the first method, only one of pins of each of the TFT-LCD modules having respectively an RGB interface technique and a data enable interface technique is made to coincide with an LCD detect pin of the LCD module detecting circuit 30. The coinciding pin of the TFT-LCD module of the RGB interface technique is connected with a power pin therein, and thereby generates a high-level identification signal. In contrast, the coinciding pin of the TFT-LCD module of the data enable technique is connected with a ground pin therein, and thereby generates a low-level identification signal. Accordingly, the video controller 10 receives the high-level identification signal outputted through the coinciding pin, of the TFT-LCD module of the RGB interface technique, or the low-level identification signal of the TFT-LCD module of the data enable interface technique. In such a manner, the video controller 10 identifies a TFT-LCD module which is currently being mounted.

In the second method, two system main boards are made. On the two system main boards, all parts including the video controller 10 and the LCD module driving voltage supply unit 20 are constructed in the same manner, except an LCD module detecting circuit 30. Here, as for a system main board for detecting the TFT-LCD module of the RGB interface technique, the LCD module detecting circuit 30 is provided with a pull-up resistor to thereby generate a high-level identification signal. And, as for a system main board for detecting the TFT-LCD module of the data enable interface technique, the LCD module detecting circuit 30 is provided with a pull-down resistor to thereby generate a low-level identification signal. Accordingly, only by replacing a driving system main board of a TFT-LCD according to an interface technique of the TFT-LCD, TFT modules having respectively different interface techniques may be mounted in the TFT-LCD driving system in accordance with the present invention.

Namely, the LCD module detecting circuit 30 is provided with a pull-up resistor and a pull-down resistor so as to output a high-level identification signal with the pull-up resistor when the detected TFT-LCD module is the TFT-LCD module 40 of the RGB-interface technique, and to output a low-level identification signal with the pull-down resistor when the detected TFT-LCD module is the TFT-LCD module 50 of the data enable interface technique.

Thereafter, the video controller 10 receives the high-level identification signal or the low-level identification signal outputted from the LCD module detecting circuit 30, determines an interface technique of a currently-mounted TFT-LCD module on the basis of the received identification signal, and generates an interface signal or a control signal for driving the TFT-LCD module by software. For example, the video controller 10 executes a software driver for driving the TFT-LCD module of the RGB interface technique when the identification signal is a high-level signal, and the video controller 10 executes a software driver for driving the TFT-LCD module of the data enable interface technique when the identification signal is a low-level signal, thereby driving the TFT-LCD.

Also, the video controller 10 has all interfaces of TFT-LCD modules which the controller 10 is to recognize and drive. Since the TFT-LCD module of the RGB interface technique and the TFT-LCD module of the data enable interface technique are used in the present embodiment, the controller 10 includes an RGB interface and a data enable interface. At this time, the generated interface signal and the control signal are transmitted to the detected TFT-LCD module through an interface of the video controller 10 which coincides with the interface of the detected TFT-LCD module.

Also, the video controller 10 drives the LCD module driving voltage supply unit 20 to supply a voltage for driving the detected TFT-LCD module. Here, the LCD module driving voltage supply unit 20 supplies a driving voltage suitable for the detected TFT-LCD module according to a control signal of the video controller 10.

Through such processes, all voltages and signals for driving the TFT-LCD module mounted in a current system are supplied, so that the detected TFT-LCD module is normally operated.

In addition, when the TFT-LCD module of the RGB interface technique is detected, the video controller 10 grounds every pin allotted for a data enable interface by software, so that the system can be stably operated. Namely, the video controller grounds all pins, except pins allotted for an interface of a detected TFT-LCD module so that malfunctioning of the TFT-LCD driving system due to the unallotted pins can be prevented.

The TFT-LCD driving system having such a structure can be employed all kinds of portable terminals using a TFT-LCD as a display, such as display driving systems of a mobile phone, a PDA phone, a smart phone and the like.

Also, the TFT-LCD driving system and its method in accordance with the present invention can be used not only for the TFT-LCD module of the RGB interface technique and the TFT-LCD module of the data enable interface technique but also for TFT-LCD modules using other interface techniques.

As so far described, the present invention allows at least two kinds of TFT-LCD modules using respectively different interface techniques to be compatible in a terminal using a TFT-LCD as a display device. Accordingly, there is no need to make another system to use a TFT-LCD module having a different interface technique. Also, when a TFT-LCD module of one interface technique is in short supply, the module can be desirably substituted by a TFT-LCD module of another interface technique.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A thin film transistor liquid crystal display (TFT-LCD) driving system, comprising:

an LCD module detecting circuit configured to detect a first TFT-LCD module or a second TFT-LCD module and generate an identification signal corresponding to an interface technique of the detected first or second TFT-LCD module, wherein the LCD module detecting circuit has an LCD detect pin coupled to at least one pin of the first or second TFT-LCD module for detecting the first or second TFT-LCD module by determining a voltage assigned to the LCD detect pin, wherein the first and second TFT-LCD modules have different interface techniques;

a video controller configured to receive the identification signal and recognize the interface technique of the detected first or second TFT-LCD module according to the received identification signal and drive the detected first or second TFT-LCD module according to the recognized interface technique; and an LCD module driving voltage supply unit configured to supply a first driving voltage or a second driving voltage to the detected first or second TFT-LCD module, based on the recognized interface technique.

2. The system of claim 1, wherein the video controller generates an interface signal and a control signal for driving the detected first or second TFT-LCD module, and transmits the generated interface signal and control signal to the detected first or second TFT-LCD module.

3. The system of claim 2, wherein the video controller comprises a plurality of interfaces and transmits the generated interface signal and control signal to the detected first or second TFT-LCD module through an interface of the detected TFT-LCD module among the plurality of interfaces.

4. The system of claim 2, wherein the interface signal and the control signal for driving the detected first or second TFT-LCD module are signals generated by software.

5. The system of claim 1, wherein the LCD module detecting circuit comprises a pull-up resistor and a pull-down resistor.

6. The system of claim 5, wherein the identification signal is a high-level signal from the pull-up resistor or a low-level signal from the pull-down resistor.

7. The system of claim 6, wherein the high-level signal is an identification signal generated when the detected first or second TFT-LCD module employs an RGB interface technique.

8. The system of claim 6, wherein the low-level signal is an identification signal generated when the detected first or second TFT-LCD module employs a data enable interface technique.

9. The system of claim 1, wherein the interface technique of the detected first or second TFT-LCD module is an RGB interface technique or a data enable interface technique.

10. The system of claim 9, wherein the video controller grounds all pins allotted for a data enable interface when the recognized interface technique is an RGB interface technique.

11. The system of claim 1, wherein the LCD module detecting circuit comprises an LCD detect pin connected to a power pin or a ground pin of the TFT-LCD module, for identifying an interface technique of the detected first or second TFT-LCD module.

12. The system of claim 1, wherein the LCD module driving voltage supply unit supplies power for driving the detected first or second TFT-LCD module by control of the video controller.

13. A thin film transistor liquid crystal display (TFT-LCD) driving method, comprising:

detecting a first TFT-LCD module or a second TFT-LCD module and generating an identification signal corresponding to an interface technique of the detected first or second TFT-LCD module, wherein at least one pin of the first or second TFT-LCD module is coupled to an LCD detect pin for detecting the first or second TFT-LCD module by determining a voltage assigned to the LCD detect pin, wherein the first and second TFT-LCD modules have different interface techniques;

recognizing the interface technique of the detected first or second TFT-LCD module according to the generated identification signal; and supplying a first driving voltage or a second driving voltage to the detected first or second TFT-LCD module, based on the recognized interface technique.

14. The method of claim 13, further comprising:

generating an interface signal and a control signal for driving the detected first or second TFT-LCD module and transmitting the generated interface signal and control signal to the detected first or second TFT-LCD module.

15. The method of claim 14, wherein the generated interface signal and the control signal are transmitted to the detected first or second TFT-LCD module through an interface of the detected first or second TFT-LCD module among a plurality of interfaces provided in the video controller.

16. The method of claim 14, wherein the generated interface signal and the control signal are signals generated by software.

17. The method of claim 13, wherein the identification signal is a high-level signal from a pull-up resistor or a low level signal from a pull-down resistor.

18. The method of claim 17, wherein the high-level signal is an identification signal generated when the detected first or second TFT-LCD module employs an RGB interface technique.

19. The method of claim 17, wherein the low-level signal is an identification signal generated when the detected first or second TFT-LCD module employs a data enable interface technique.

20. The method of claim 13, wherein the interface technique of the detected first or second TFT-LCD module is an ROB interface technique or a data enable interface technique.

21. The method of claim 20, wherein all pins allotted from a data enable interface are grounded by software when the interface technique of the detected first or second TFT-LCD module is an ROB interface technique.

22. A thin film transistor liquid crystal display (TET-LCD) driving system, comprising:

an LCD module detecting circuit configured to detect a first TFT-LCD module or a second TFT-LCD module and generate an identification signal corresponding to an interface technique of the detected first or second TFT-LCD module, wherein the LCD module detecting circuit has an LCD detect pin coupled to at least one pin of the first or second TFT-LCD module for detecting the first or second TFT-LCD module by determining a voltage assigned to the LCD detect pin, wherein the first TFT-LCD module has an ROB interface technique and the second TFT-LCD module has a data enable interface technique;

a video controller configured to receive the identification signal and recognize the interface technique of the detected first or second TFT-LCD module according to the received identification signal and drive the detected first or second TFT-LCD module according to the recognized interface technique; and an LCD module driving voltage supply unit configured to supply a first driving voltage or a second driving voltage to the detected first or second TFT-LCD module, based on the recognized interface technique.

* * * * *